United States Patent [19]

Petty et al.

[11] Patent Number: 5,061,131

[45] Date of Patent: Oct. 29, 1991

[54] STRUCTURE AND METHOD FOR RESTRAINING MOTION OF A MARINE STRUCTURE

[75] Inventors: Terry D. Petty, Kenner; Luc G. Chabot, LaPlace, both of La.

[73] Assignee: Odeco, Inc., New Orleans, La.

[21] Appl. No.: 488,663

[22] Filed: Mar. 5, 1990

[51] Int. Cl.[5] ..... E02B 17/00; E02D 21/00

[52] U.S. Cl. ..... 405/224; 114/264; 114/293; 405/202

[58] Field of Search ..... 405/224, 195, 202, 203-207; 166/350, 359, 367; 175/5-7; 114/264, 265, 293

[56] References Cited

U.S. PATENT DOCUMENTS

Re. 32,119 4/1986 Abbott et al. ..... 405/224 X
2,889,795 6/1959 Parks ..... 405/224 X
4,155,673 5/1979 Yashima ..... 405/224
4,372,706 2/1983 Young ..... 405/224 X

*Primary Examiner*—Dennis L. Taylor
*Attorney, Agent, or Firm*—Stephen R. Doody

[57] ABSTRACT

A marine structure situated in a seabed having mooring means designed to provide resistance to the environmental forces acting on the structure. Weights are attached to the mooring means at a distance above the seabed so that the weights do not touch the seabed during normal operating conditions. When extreme environmental loads move the structure a certain distance leeward of its original locations, the weights on leeward mooring means contact the seabed, significantly and immediately increasing the restoring force provided by the mooring means.

13 Claims, 4 Drawing Sheets

STRUCTURE AND METHOD FOR RESTRAINING MOTION OF A MARINE STRUCTURE

FIELD AND BACKGROUND OF THE INVENTION

The present invention relates in general to marine structures, particularly those structures employed for the purposes of drilling for and/or producing oil and gas in offshore areas. Such structures are typically held in position over a seabed site by use of spread mooring systems, which are comprised of a multiplicity of mooring means arranged in a radial pattern around the perimeter of the structure. Each individual mooring means generally comprises an anchor, a wire cable, and sometimes an anchor chain in combination with a wire cable. Through the use of said mooring means, the structure is maintained in a desired location, thereby allowing oil and gas production and drilling to take place.

When environmental forces, such as wind, current and waves, act against the structure to move it away from its original location, spread mooring systems develop a net horizontal force called the "restoring" force which restrains unwanted movement of the structure and ultimately "restores" the structure to its original location. The restoration force is developed by the increasing tensions in the mooring lines located on the side of the structure experiencing the environmental forces (the "windward" side), as those lines become increasingly taut due to the movement of the structure, coupled with decreasing tension in the mooring lines located on the leeside of the structure.

The structure reaches a maximum lateral offset from its original position when the horizontal vector sum of the mooring line tensions is equal and opposite to the mean horizontal environmental forces acting on the structure. When the environmental forces have subsided, as for example when a storm has passed, the restoration force causes the structure to return to its original position. Spread mooring systems allow maximum lateral offsets in any given direction away from structure's original position, thereby defining a "watch circle" beyond which the structure will not be moved even under the most severe environmental loads which the structure may be expected to encounter.

The use of weights ("clump weights") on the seabed in conjunction with spread mooring systems is a known means of improving the station-keeping properties of a mooring system. U.S. Pat. No. 3,903,705 to Beck discloses the use of clump weights attached to the mooring lines, said clump weights being intended to remain at least partially resting on the seabed under normal environmental conditions. In Beck's device, the clump weights are never removed completely off the seabed except in the event of abnormal environmental forces such as those that may occur in a severe storm.

However, the mooring system disclosed by Beck has certain disadvantages. For one thing, the clump weights of Beck, which normally are at least partially supported on the sea floor, are susceptible to adhesion to the sea floor, as Beck himself recognized. Gradual subsidence and burial of at least a portion of Beck's clump weights, resting on soft bottoms for long periods of time, may prevent the clumps from lifting off bottom in the event of a severe storm as originally intended.

Moreover, Beck's mooring system is intended to provide stiff lateral restraint for a guyed tower having a bottom which rests on and is affixed to the sea floor.

Due to the nature of such a bottom-fixed tower, Beck's mooring system needs to contend only with lateral motions of the upper end of the tower. By contrast, the design of spread mooring systems for a floating structure is much more complex, since the mooring must take into account the vertical (heave), rotational (roll, yaw, pitch) and horizontal (surge and sway) motions of floating structures. The stiff behavior of Beck's configuration in "normal" weather, i.e. weather conditions insufficient to cause the clump weights to lift off bottom, would generally have undesirable effects on the motions and natural periods of heave, roll and pitch motions of floating structures.

SUMMARY OF THE INVENTION

The present invention provides a marine structure, whether floating or bottom-fixed, with spread mooring system having improved station-keeping capability and which eliminates the problems associated with adhesion of clump weights to the sea floor. The invention provides a mooring system having clump weights which are positioned above and completely off the seabed under normal conditions, thereby providing a desirably compliant restraint to all the degrees of motions of the structure. According to the invention, when extreme environmental forces move the structure away from its original location and towards the periphery of its "watch circle", the clump weights on leeward mooring lines come to rest on the sea bottom, greatly and immediately increasing the restoring force of the mooring system.

Hence, the unfavorable aspects associated with subsidence and adhesion of clump weights which are ordinarily at rest on the seabed for long periods of time, as in Beck, are eliminated by the invention. Moreover, the large restoring forces required for good station-keeping performance, rather than being generated stiffly by a line pulling against a heavy clump resting at least partially on bottom, as in Beck, are instead generated by the large and immediate reduction in leeside mooring line tension induced by the leeside clumps being lowered to the sea bottom, while maintaining compliant restraint in the windward lines. This increase in restoring force capacity is achieved passively without the need for a marine crew to slacken leeward lines, as would otherwise be required by good marine practice for floating structures experiencing a violent storm.

Additionally, total "pull down" weight or vertical force of the mooring system of the invention is substantially reduced when the leeside clumps are set onto the seabed during storm conditions. This permits a floating structure to passively reduce its draft, thus allowing additional air gap for storm waves to pass under the deck of the floating structure.

DESCRIPTION OF THE PREFERRED EMBODIMENTS

Figure 2:
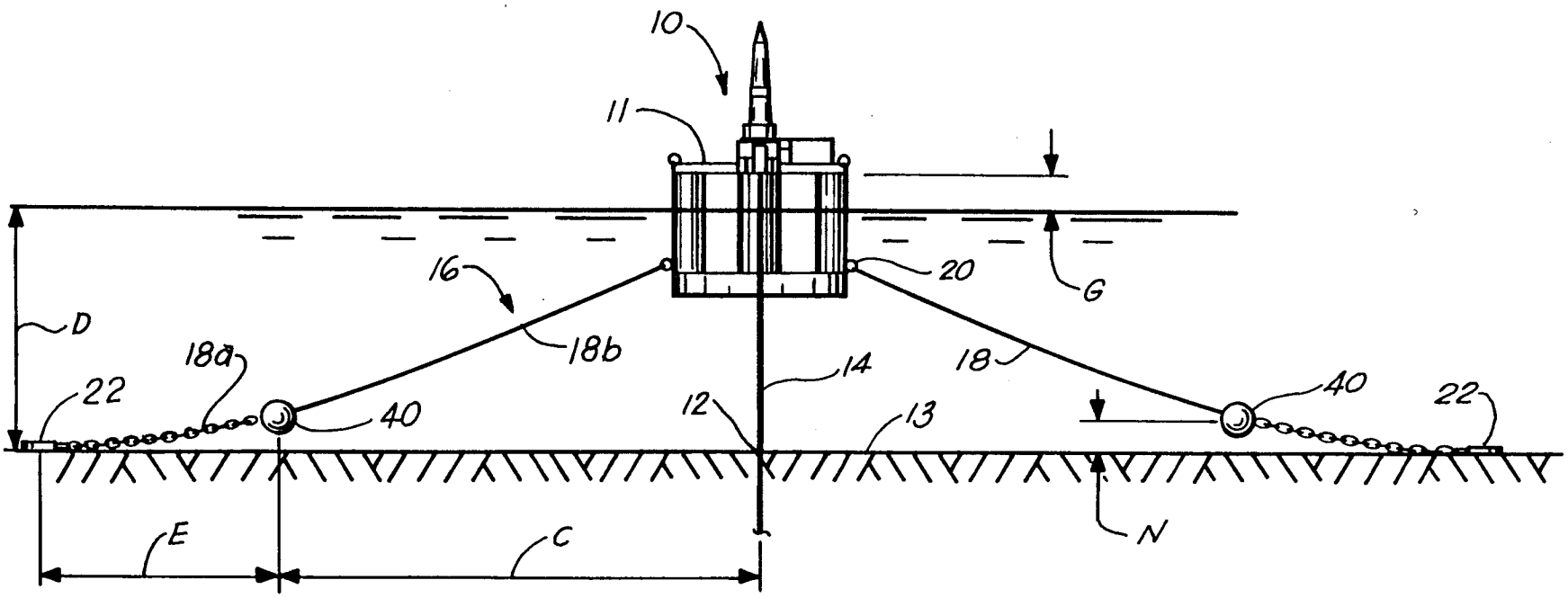
FIG. 2 is an elevational view of a floating structure in accordance with the present invention under normal operating conditions, taken along line 2—2 of FIG. 1.

The objects and advantages of the present invention are achieved through the provision of a marine structure, as for example the floating drilling and production platform 10 which is best depicted in FIG. 2. Although the fullest benefits of the invention are achieved in a marine structure which is floating, i.e., one which rises with a rising tide and falls with a falling tide, the invention also relates to all types of marine structures including tension leg platforms, bottom-fixed towers and partially buoyant structures which touch or partially rest on the seabed.

Figure 1:
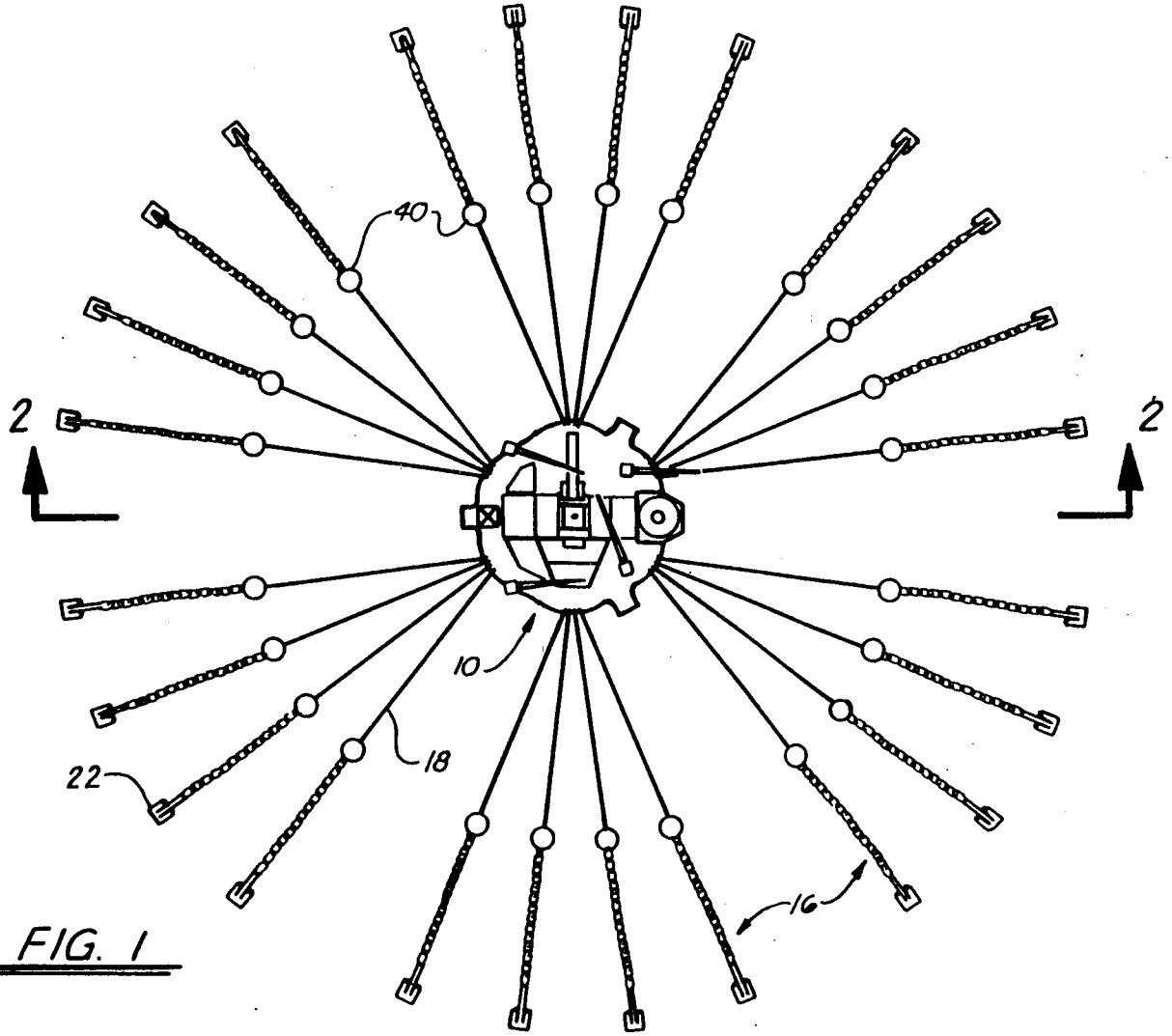
FIG. 1 is a top view of a structure according to the present invention.

As shown in FIG. 2, the structure is situated over a desired original site 12 of the seabed 13, such that drill pipe and production risers 14 may extend in a substantially vertical line between the seabed site 12 and the structure 10. The structure is held in position over the desired seabed site by a plurality of mooring means 16. In the preferred embodiment, as shown in FIG. 1, the mooring means are arranged in a radially symmetrical pattern around the perimeter of the structure. For the sake of clarity, only two mooring means 16 have been depicted in FIG. 2.

As shown in FIGS. 1 and 2, mooring means 16 comprises a mooring line 18, one end of which extends from a fairlead 20 on the structure to the seabed 13 and is attached to an anchor 22 on the seabed. Although depicted as a drag-type anchor in FIG. 2, anchor 22 may take any form, including pile anchors and gravity anchors.

In the preferred embodiment of the mooring means 16, as shown on the left-hand side of FIG. 2, mooring line 18 comprises a wire cable **18*b* except for its lowermost segment 18*a* situated on or near the seabed, said segment 18*a*** comprising a material which is heavier and more abrasive-resistant than wire cable, such as anchor chain. In such combination chain-wire cable mooring lines, the chain and wire cable are connected using any of a number of conventional techniques.

Figure 3:
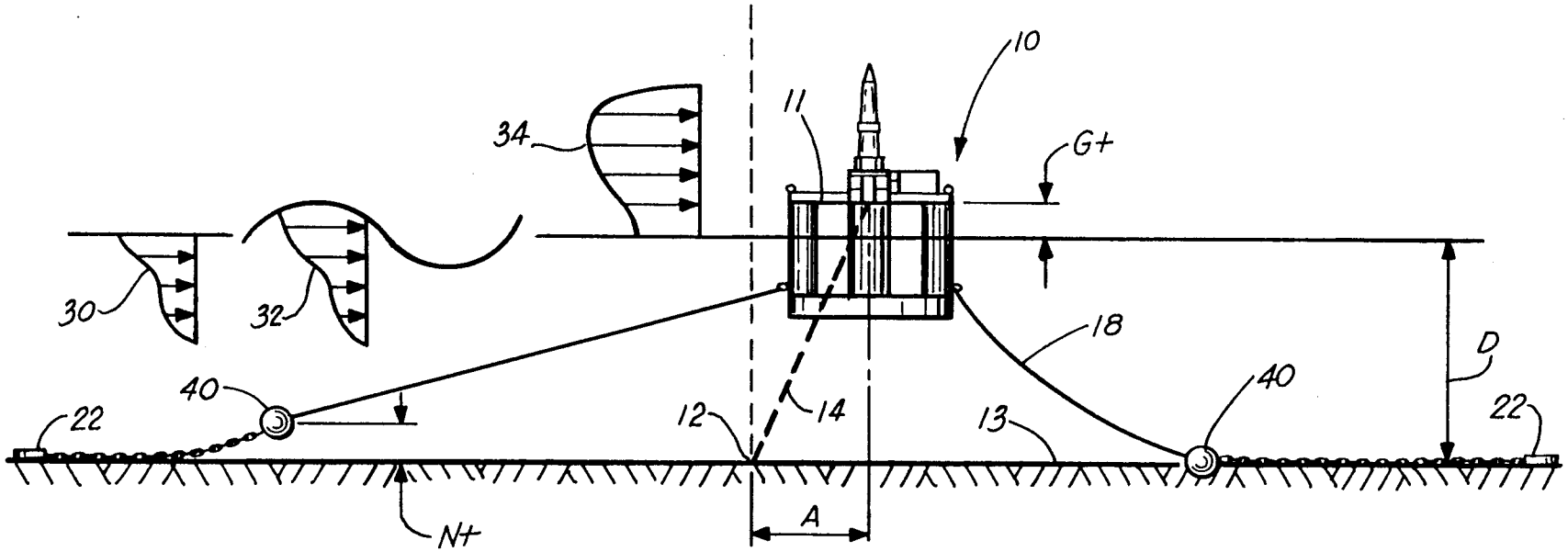
FIG. 3 is an elevational view of the floating structure illustrated in FIG. 1, except that it is displaced horizontally from its original position by extreme environmental loads.

Because of the limited flexibility of drill pipe and production riser 14, it is important that the mooring means limit the lateral displacement of the structure, shown as distance "A" in FIG. 3, within allowable tolerances. The maximum allowable horizontal offset in any given direction away from the structure's original site 12 defines a "watch circle", having a radius of "A", beyond which the structure may not move without an unacceptable risk of damage to or destruction of the drill pipe and/or production risers 14. For example, the watch circle for a floating structure conducting drilling and/or production operations is preferably less than 10% of the water depth, said depth being shown as "D" in FIG. 3.

Since production risers 14 cannot be readily disconnected from a marine structure, it is crucial that the mooring means 16 have the capability of keeping the structure's lateral displacement within the watch circle even when the structure is subjected to extreme environmental forces such as ocean currents 30, waves 32 and wind 34 that may be encountered as a result of severe storms, as depicted in FIG. 3. Moreover, the mooring means must be such as to not adversely affect the motion characteristics and the natural periods of heave, roll and pitch degrees of freedom of the structure, especially when the structure 10 is a floating structure.

The invention also includes one or more clump weights 40 attached to one or more of the mooring means 16 as shown in FIGS. 1 and 2. In the preferred embodiment, at least one clump weight is attached to each of the mooring means 16, as shown in FIG. 1.

The clump weights 40 are fixedly attached to the mooring means at such a position, and in such a manner, so that all clump weights are completely out of contact with the seabed 13 during ordinary or normal operating conditions, as is depicted in FIG. 2. The clump weights 40 so attached to the mooring means 16 provide a desirably compliant restraint to all degrees of motion of the structure 10, especially a floating structure, without adversely affecting the natural periods of the structure's heave, roll or pitch.

All of the mooring means 16, in the absence of environmental forces, apply a substantially equal force on the structure 10, thereby generating a zero restoring force on the structure which keeps it an equilibrium position over the desired seabed site. FIG. 2 shows the structure 10 of the invention in such a position of equilibrium.

Figure 4:
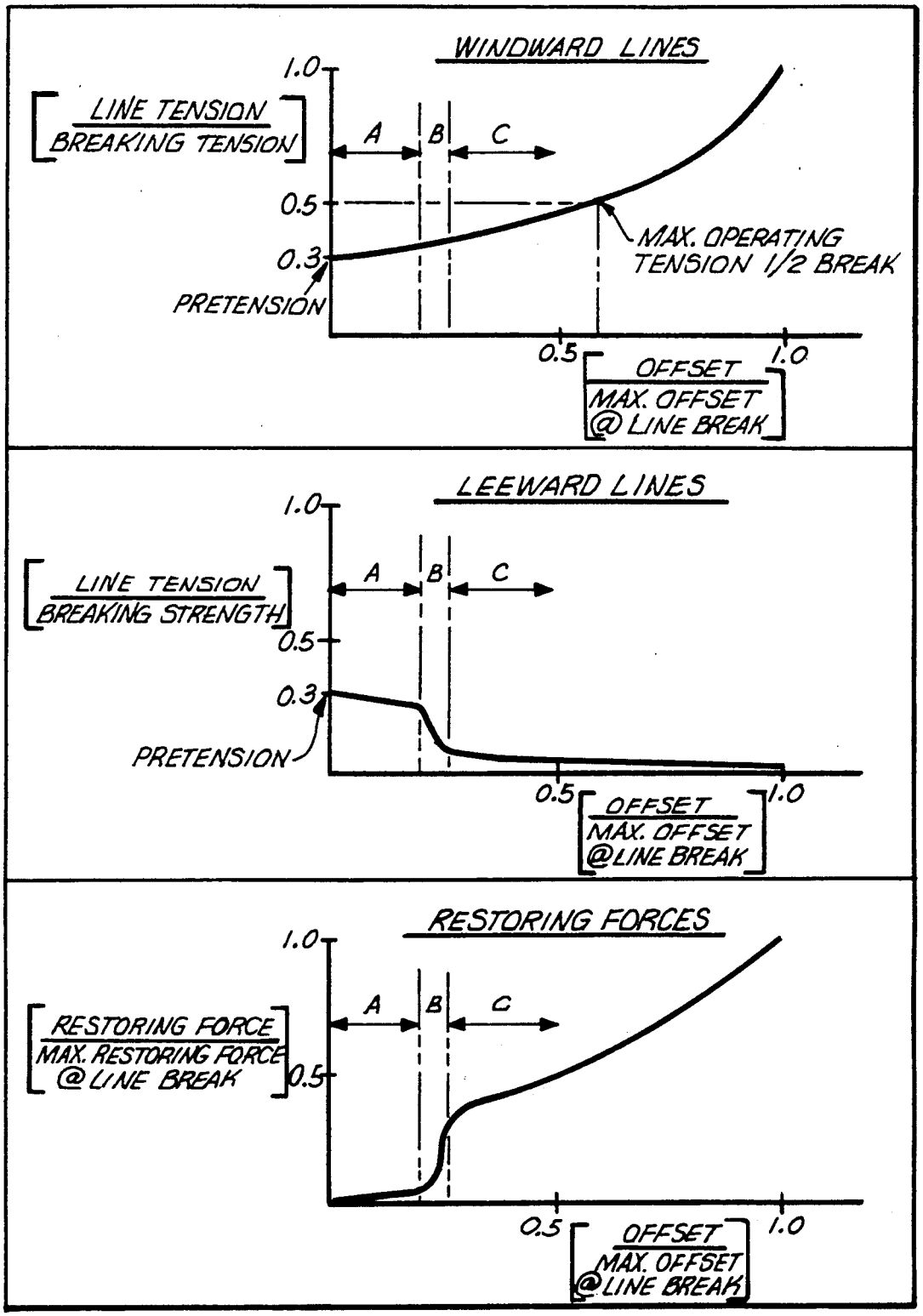
FIG. 4 illustrates the relationships between lateral offset, line tension and restoring force in accordance with the invention.

When subjected to normal environmental forces, the structure 10 moves horizontally in the direction of the prevailing environmental forces. Upon such movement from its equilibrium position, the tension in the mooring lines 18 on the windward side of the structure increases, while the tension in the mooring lines on the leeward side of the structure decreases, thereby generating a restoring force in the direction opposing the environmental forces. Such restoring force increases with increasing offset of the structure 10. When the restoring force substantially equals the environmental forces, further lateral displacement of the structure 10 will cease, corresponding to regime "A" on the restoring force curve shown in FIG. 4. Under all but the most extreme environmental forces, all clump weights 40 remain off bottom and the mooring lines provide compliant restraint to the structure 10.

Under extreme environmental forces, such as those experienced during a violent storm, the generated restoring force may be less than the environmental forces, in which event the structure will experience a further lateral displacement. As such lateral displacement of the structure continues, the mooring lines 18 on the leeward side of the structure slacken, thereby reducing the height of the attached clump weights above the seabed.

As the horizontal displacement of structure 10 increases, the clump weights 40 on the leeside mooring lines get closer and closer to the seabed 13. In accordance with the invention, as the structure 10 reaches the periphery of its watch circle, the clump weights 40 on one or more of the leeside mooring lines 18 come to rest on the seabed 13, as shown in FIG. 3. When that happens, there is a significant and immediate decrease in the tension of the mooring lines 18 (corresponding to regime B in FIG. 4) to which such resting clump weights 40 are attached, which significantly and immediately increases the restoring force (corresponding to regime C in FIG. 4) to a point sufficient to resist the most extreme environmental forces which the structure may encounter.

While the clump weight 40 utilized in accordance with the present invention can take many forms, in a preferred embodiment of the present invention the clump weight 40 takes the form of a single, large concrete block or cylinder. Other forms of clump weights, such as a plurality of smaller, closely spaced clump weights, would also be within the scope of the present invention, provided all of said multiple clump weights are completely off the seabed during normal operating conditions. The use of a single clump weight versus a multiple segmented clump weight arrangement is not a functional requirement of the invention, but rather a choice governed by fabrication, transportation and installation considerations.

In accordance with the preferred embodiment of the present invention, the horizontal distance "C" along the ocean floor between the seabed site 12 and clump weight 40, depicted in FIG. 2, is approximately one and one-half times the water depth D in which the structure 10 is located. Also in the preferred embodiment, the horizontal distance "E" along the ocean floor between the clump weight 40 and anchor 22, as shown in FIG. 3, is preferably less than one-half the water depth D.

The height of the clump weights 40 above the seabed under normal operating conditions shown as the distance N in FIG. 2, may vary depending upon the environmental loads which the structure is designed to withstand and the size of the watch circle within which the structure may move without damage to drill pipe or production risers 14. In the preferred embodiment of the invention, the clump weights under normal operating conditions should be at a height N above the seabed equal to a distance less than the distance A, so that the clump weights reach the seabed before the structure reaches the periphery of the watch circle.

Lengths C and E may be reduced or increased with a corresponding decrease or increase in environmental loads which the structure is designed to withstand. However, the distance "E" must be of such a length that even when the clump weights 40 on the windward mooring lines 18 are raised higher than normal above the seabed during a violent storm, depicted as N+in FIG. 3, the end portions of said mooring lines adjacent their respective anchors 22 should remain substantially horizontal, thereby eliminating any tendency for uplift of anchor 22.

The weight of the clump weights 40 can vary within wide limits, said weight being mostly a function of keeping the structure 10 within the watch circle required to prevent damage to the risers and drill pipe 14. The clump weight 40 can be essentially considered as a point load, having a weight which is substantially in excess of the unit weight per foot of mooring lines 18.

The weight of the clump weight 40 is also a function of the breaking strength of the mooring means 16, which determines the allowable operating tensions in mild environments and the maximum allowable tension in extreme environments. Conventional design practice requires that the maximum allowable mooring means tension in extreme environments is generally limited to one-half of the breaking strength of that portion of mooring means 16 at the point of its attachment to the structure. The range of allowable mooring means operating tensions in normal environments is 15–30% of the breaking strength. Within these guidelines, it is therefore possible to determine the optimum parameters and components of the invention.

An example of one preferred embodiment of the invention comprises a floating structure located in a water depth of 3000 feet, with a watch circle having a radius of 90 feet. In such embodiment, each mooring line 18 may comprise an anchor chain 18*a, as shown in FIG. 2, which is* 1500 feet long, the anchor chain size being 6 inches nominal. Segment 18*b* of each mooring line 18 may be comprised of 5 inch diameter wire rope, 4600 feet in length, with a rated breaking strength of 3400 kips, operating at a pretension of 30% of the breaking strength. The clump weight 40 may comprise a single clump weighing 300 kips, attached to the mooring line at the connection between 18*a* and 18*b*, and suspended approximately 15 to 30 feet above the seabed during normal operating conditions. In this example of the invention, the distance C is approximately 3600 feet and the distance E is approximately 1500 feet.

The structure and method of the invention provide several advantages not associated with known mooring systems for anchoring floating structures at sea, including the following:

(a) The mooring means 16 of the present invention are capable of generating much larger restoring forces than conventional means, while remaining relatively compliant for all waves including very large design waves, so as to not cause undesirable effects on the motions and natural periods of motions of the floating structure 10.

(b) The invention eliminated the problems of adhesion and related operational risks associated with the subsidence of clump weights designed to rest on the seabed during normal operating conditions.

(c) The greatly improved station-keeping characteristics of the mooring means 16 reduce the fatigue wear on rigid production risers 14 in the most frequently occurring environments and prevents structural failure of the risers in the rarely occurring extreme environments.

(d) The soft, compliant behavior of the mooring means 16 reduces the magnitude of the wave-induced cyclic load variation in the components of the mooring means 16 and floating structure 10, thereby increasing the fatigue life of said components and structure.

(e) In extreme environments, the passive lowering of the leeside clump weights 40 onto the seabed 13 increases the restoring capacity of the mooring means 16 without the need of intervention by the marine crew and without having to rely on the operation of equipment on the structure 10.

(f) The use of the clump weights 40 normally off bottom, in addition to the advantages mentioned above, retains the advantage usually attributed to clump weights normally on bottom, which is to prevent any significant vertical uplift on the anchors even in the largest waves, thereby decreasing the possibility of pile pullout. This also permits the use of drag anchors which are generally less costly than pile anchors, thereby making the invention economically attractive. It also reduces the length of chain 18*a* required for chain-wire combination mooring lines, thereby reducing the cost of the mooring system.

(g) The total pull down weight or vertical force of the mooring system is substantially reduced when the clump weights 40 on the leeside mooring lines are set onto the seabed 13 during storm conditions. This positive aspect permits a floating structure 10 to passively reduce its draft, thereby increasing its normal air gap "G", shown in FIG. 2, to a greater air gap "G+" as shown in FIG. 3, which facilitate the passage of storm wave under the deck 11 of structure 10.

While a specific embodiment of the invention has been shown and described in detail to illustrate the application of the principles of the invention, it will be understood that the invention may be embodied otherwise without departing from such principles.

What is claimed is:

1. A structure for restraining motion during environmental loading, comprising A marine structure situated in a body of water at a desired location above a seabed;

Means for mooring the marine structure; and

At least one weight attached to the mooring means at a distance above the seabed so that said weight does not touch the seabed when the marine structure is at its desired location, but does touch the seabed in response to movement of the marine structure laterally away from its desired location.

2. A method for mooring a marine structure situated in a body of water at a desired location above a seabed, comprising the steps of:

(a) Attaching mooring means from the structure to the seabed; and (b) Attaching at least one weight to the mooring means at a distance above the seabed so that the weight does not touch the seabed when the marine structure is at its desired location, but does touch the seabed in response to movement of the marine structure laterally away from its desired location.

3. The structure of claim 1 including a plurality of weights, none of which touches the seabed when the marine structure is at its location, and wherein at least one of said weights touches the seabed in response to movement of the marine structure laterally away from its desired location.

4. The structure of claim 1 wherein said weight touches the seabed in response to movement of the structure laterally a predetermined distanced away from its desired location.

5. A structure for restraining motion during environmental loading, comprising:

a marine structure situated in a body of water above a desired seabed site;

means for mooring the marine structure so that lateral displacement of the marine structure away form the desired seabed site is limited to an allowable offset beyond which the marine structure may not move without unacceptable risk of damage; and at least one weight attached to the mooring means at a distance above the seabed such that the weight touches the seabed only in response to movement of the marine structure beyond said allowable offset.

6. The structure of claim 5 wherein the marine structure includes a drill pipe extending to the seabed.

7. The structure of claim 5 wherein the marine structure includes a production riser extending to the seabed.

8. A structure for restraining motion during environmental loading, comprising:

a marine structure situated in a body of water above a desired seabed site, said marine structure including an extension therefrom to the seabed, said extension having limited flexibility such that movement of the marine structure laterally away from said desired seabed site in any given direction defines a watch circle beyond which the marine structure may not move without an unacceptable risk of damage;

means for mooring the marine structure; and at least one weight attached to the mooring means at a distance above the seabed such that the weight touches the seabed only in response to movement of the marine structure towards the periphery of the watch circle.

9. The structure of claim 8 including a plurality of said weights and wherein at least one of said weights touches the seabed before the marine structure reaches said watch circle.

10. The structure of claim 8 including a plurality of said weights and wherein at least one of said weights touches the seabed as the marine structure reaches said watch circle.

11. An apparatus for restraining environmentally induced motion of a marine structure situated in a body of water above a desired seabed site, comprising:

means for mooring said marine structure to the seabed, said means comprising a plurality of mooring lines each having one end connected to said structure and the other end extending to the seabed at a location spaced outwardly from the structure, said mooring lines being distributed around the structure; and a plurality of weights attached to a plurality of said mooring lines at a distance above the seabed such that none of said weights touch the seabed except in response to environmentally induced movement of the structure laterally away from the desired seabed site.

12. The apparatus of claim 11 wherein the marine structure is a floating vessel.

13. The apparatus of claim 11 wherein the average horizontal distance between the desired seabed site and the respective weights is greater than the water depth at the desired site.

* * * * *